US011618999B2

(12) United States Patent
Sera et al.

(10) Patent No.: US 11,618,999 B2
(45) Date of Patent: Apr. 4, 2023

(54) ROPE AND ELEVATOR USING SAME

(71) Applicant: MITSUBISHI ELECTRIC CORPORATION, Chiyoda-ku (JP)

(72) Inventors: Masaya Sera, Chiyoda-ku (JP); Hiroyuki Nakagawa, Chiyoda-ku (JP); Haruhiko Kakutani, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 807 days.

(21) Appl. No.: 16/347,232

(22) PCT Filed: Aug. 21, 2017

(86) PCT No.: PCT/JP2017/029799
§ 371 (c)(1),
(2) Date: May 3, 2019

(87) PCT Pub. No.: WO2018/131203
PCT Pub. Date: Jul. 19, 2018

(65) Prior Publication Data

US 2019/0315596 A1 Oct. 17, 2019

(30) Foreign Application Priority Data

Jan. 10, 2017 (JP) ..... JP2017-001828

(51) Int. Cl.
*D07B 5/04* (2006.01)
*B66B 7/06* (2006.01)
(Continued)

(52) U.S. Cl.
CPC ..... *D07B 5/045* (2021.01); *B66B 7/06* (2013.01); *B66B 7/062* (2013.01); *D07B 1/16* (2013.01);
(Continued)

(58) Field of Classification Search
CPC .... D07B 2201/2046; D07B 2201/2087; D07B 2201/2088; D07B 2401/201;
(Continued)

(56) References Cited

FOREIGN PATENT DOCUMENTS

CN 2496801 Y 6/2002
JP 2013-534977 A 9/2013
(Continued)

OTHER PUBLICATIONS

International Search Report dated Nov. 14, 2017 in PCT/JP2017/029799 filed Aug. 21, 2017.
(Continued)

*Primary Examiner* — Arti Singh-Pandey
(74) *Attorney, Agent, or Firm* — Xsensus LLP

(57) ABSTRACT

Provided is a rope including a load supporting member and a covering member covering an outer periphery of the load supporting member. The load supporting member includes: an impregnation material and reinforcement fiber bodies, which continuously extend in a longitudinal direction of the rope, are embedded in the impregnation material, and are configured to support a load acting in the longitudinal direction. The reinforcement fiber bodies include corrugated reinforcement fiber bodies which have, at least in part, a corrugated shape in a section parallel to the longitudinal direction. The corrugated reinforcement fiber bodies have such a length that a total length thereof given when the corrugated reinforcement fiber bodies are straightened is equal to or larger than 1.1 times a total length of the load supporting member.

11 Claims, 12 Drawing Sheets

(51) Int. Cl.
*D07B 1/16* (2006.01)
*D07B 1/22* (2006.01)

(52) U.S. Cl.
CPC ..... *D07B 1/22* (2013.01); *D07B 5/04* (2013.01); *D07B 2201/2087* (2013.01); *D07B 2501/2007* (2013.01)

(58) Field of Classification Search
CPC ..... D07B 2401/206; D07B 2501/2007; D07B 5/04; D07B 5/045; B66B 7/06; B66B 7/062; G01N 1/30
See application file for complete search history.

(56) References Cited

FOREIGN PATENT DOCUMENTS

| | | | |
|---|---|---|---|
| JP | 5713682 | B2 | 5/2015 |
| WO | WO 2009/090299 | A1 | 7/2009 |
| WO | WO 2011/142756 | A1 | 11/2011 |

OTHER PUBLICATIONS

Office Action dated May 7, 2021, in corresponding Chinese patent Application No. 201780082400.3, 14 pages.

ROPE AND ELEVATOR USING SAME

TECHNICAL FIELD

This invention relates to a rope which is to be used for, for example, an elevator or a crane, and to an elevator using the same.

BACKGROUND ART

Along with increase in height of buildings in recent years, an elevator with high lift is desired. However, as the high lift of the elevator increases, the own weight of a rope increases, with the result that it becomes more difficult to secure the safety of the rope. Thus, a rope having a light weight is required. That is, there is a limitation on reduction in weight of a related-art rope including a load supporting member, which is formed of a steel material mainly receive a load. Therefore, a rope including a load supporting member made of a material having a strength-to-weight ratio higher than that of the steel material is under development.

For example, there has been known a rope including a load supporting member made of a composite material including reinforcement fibers, such as carbon fibers or glass fibers, arranged in parallel with a longitudinal direction of the rope (for example, see Patent Literature 1).

CITATION LIST

Patent Literature

[PTL 1] JP 5713682 B2

SUMMARY OF INVENTION

Technical Problem

In general, a car of an elevator is suspended by a rope, and is raised and lowered through rotation of a drive sheave having the rope wound therearound. However, the related-art rope made of the composite material as described above includes the load supporting member having a high bending rigidity. Therefore, it is difficult to wind the rope around the drive sheave, and installation workability is poor. Moreover, the related-art rope has such a structure that the reinforcement fibers are less likely to contract and extend. Thus, when the rope is bent along the drive sheave, stress to be generated in the reinforcement fibers on a surface of the load supporting member increases. Therefore, there is a concern over the strength reliability of the rope.

This invention has been made to solve the problems described above, and has an object to obtain a rope which can be reduced in bending rigidity while achieving increase in strength and reduction in weight, and to provide an elevator using the same.

Solution to Problem

According to one embodiment of this invention, there is provided a rope, including: a load supporting member including: an impregnation material; and reinforcement fiber bodies, which continuously extend in a longitudinal direction of the rope, are embedded in the impregnation material, and are configured to support a load acting in the longitudinal direction; and a covering member covering an outer periphery of the load supporting member, wherein the reinforcement fiber bodies include corrugated reinforcement fiber bodies which have, at least in part, a corrugated shape in a section parallel to the longitudinal direction, and wherein the corrugated reinforcement fiber bodies have such a length that a total length of the corrugated reinforcement fiber bodies, which is given when the corrugated reinforcement fiber bodies, are straightened is equal to or larger than 1.1 times a total length of the load supporting member.

Further, according to one embodiment of this invention, there is provided a rope, including: a load supporting member including: an impregnation material; and reinforcement fiber bodies, which continuously extend in a longitudinal direction of the rope, are embedded in the impregnation material, and are configured to support a load acting in the longitudinal direction; and a covering member covering an outer periphery of the load supporting member, wherein the load supporting member further includes a plurality of cross members, which are spaced apart from each other in a longitudinal direction of the load supporting member and embedded in the impregnation material, wherein the cross members are each elongated so as to extend in a direction perpendicular to the longitudinal direction of the load supporting member, wherein the cross members have an elastic modulus larger than an elastic modulus of the impregnation material, wherein the reinforcement fiber bodies include corrugated reinforcement fiber bodies, which are, at least in part, wound around the cross members and formed into a corrugated shape, and wherein the corrugated reinforcement fiber bodies have such a length that a total length of the corrugated reinforcement fiber bodies, which is given when the corrugated reinforcement fiber bodies are straightened, is larger than a total length of the load supporting member.

Advantageous Effects of Invention

According to the rope of this invention, the bending rigidity can be reduced while achieving increase in strength and reduction in weight.

DESCRIPTION OF EMBODIMENTS

Now, embodiments of the present invention are described with reference to the drawings.

First Embodiment

Figure 1:
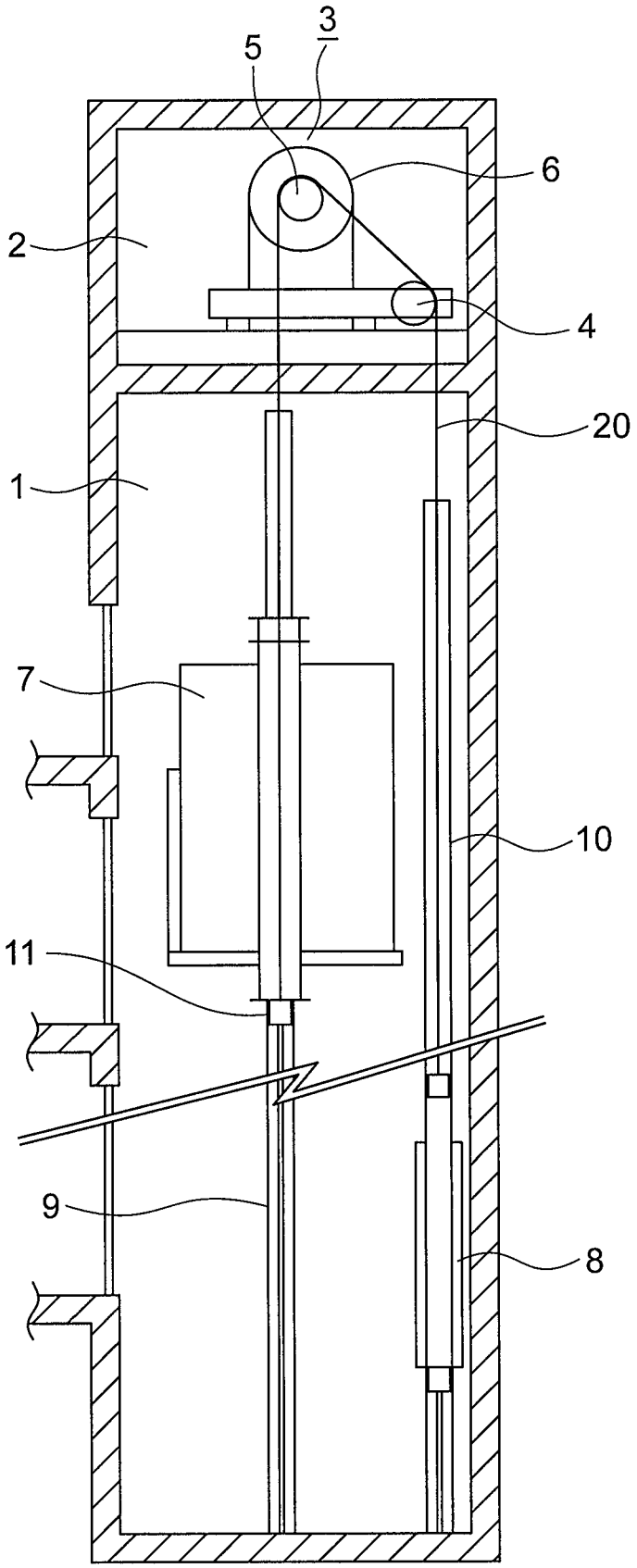
FIG. 1 is a configuration view for illustrating an elevator according to a first embodiment of this invention.

FIG. 1 is a configuration view for illustrating an elevator according to a first embodiment of this invention. In FIG. 1, a machine room 2 is provided in an upper part of a hoistway 1. In the machine room 2, there are installed a hoisting machine 3 and a deflector sheave 4. The hoisting machine 3 includes a drive sheave 5 and a hoisting machine main body 6. In the hoisting machine main body 6, there are provided a hoisting machine motor (not shown), which is configured to rotate the drive sheave 5, and a hoisting machine brake (not shown), which is configured to brake the rotation of the drive sheave 5.

A plurality of (only one is illustrated in FIG. 1) ropes 20 are wound around the drive sheave 5 and the deflector sheave 4. A car 7 is connected to a first end portion of the rope 20 in the longitudinal direction. A counterweight 8 is connected to a second end portion of the rope 20 in the longitudinal direction. The car 7 and the counterweight 8 are suspended by the rope 20, and are raised and lowered in the hoistway 1 through rotation of the drive sheave 5.

In the hoistway 1, there are installed a pair of (only one of the pair is illustrated in FIG. 1) car guide rails 9, which are configured to guide the raising and lowering of the car 7, and a pair of (only one of the pair is illustrated in FIG. 1) counterweight guide rails 10, which are configured to guide the raising and lowering of the counterweight 8. An emergency stop device 11, which is configured to grasp the pair of car guide rails 9 to urgently stop the car 7, is mounted to a lower part of the car 7.

A frictional force which acts between the rope 20 and the drive sheave 5, that is, a hoisting force is called "traction". The weight of the counterweight 8 is substantially balanced with the weight of the car 7, and serves to reduce the traction required for the rope 20 and capability of the hoisting machine 3 required for the hoisting.

In such elevator, reduction in weight of the rope 20 not only secures the safety of the rope 20 but also reduces a total weight of the elevator. Moreover, the reduction in weight of the rope 20 also reduces the size and cost of components of the elevator such as the hoisting machine 3 and the emergency stop device 11. That is, the reduction in weight of the rope 20 is advantageous in that, for example, space saving and reduction in cost of an entire system of the elevator can be achieved.

Figure 2:
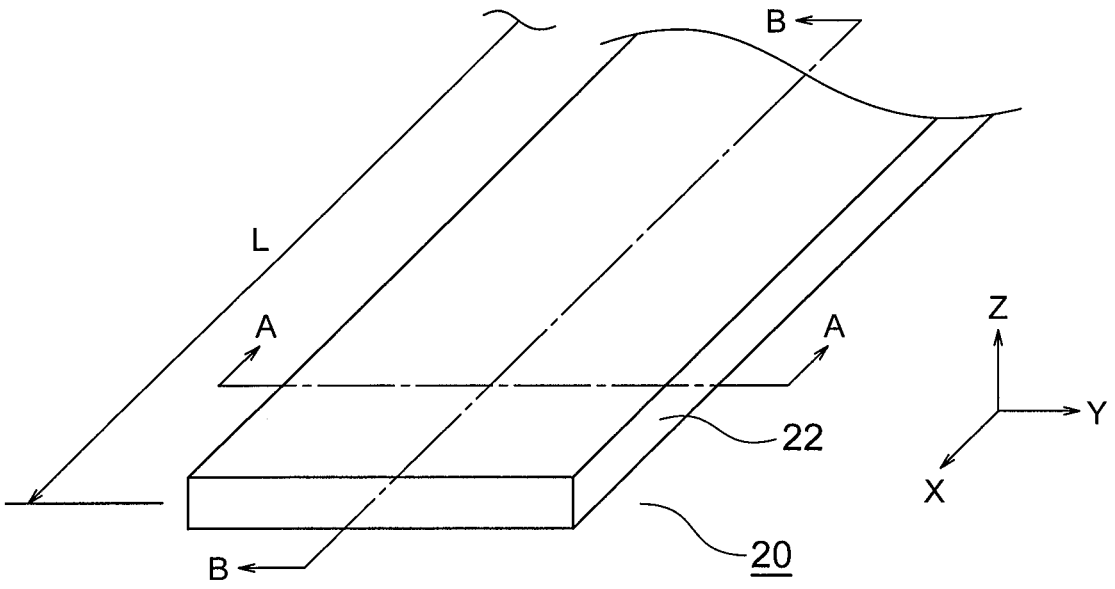
FIG. 2 is a perspective view for illustrating apart of a rope according to the first embodiment.
Figure 3:
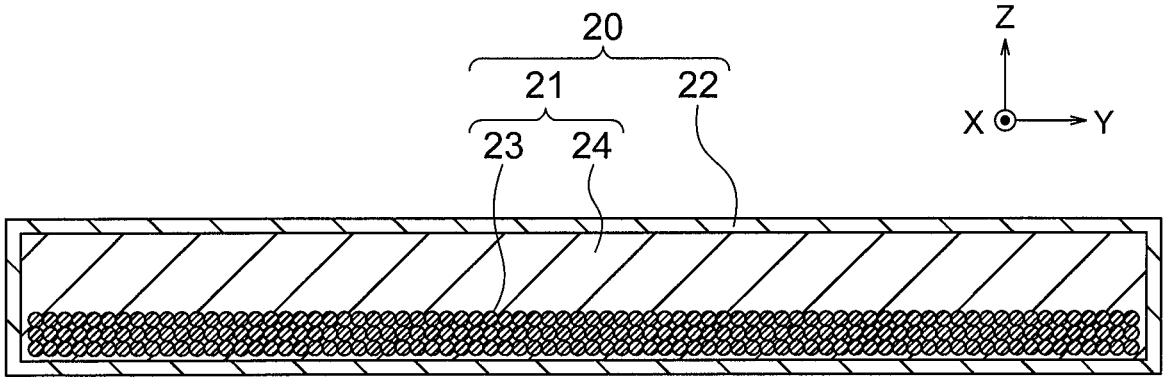
FIG. 3 is an A-A sectional view of FIG. 2.
Figure 4:
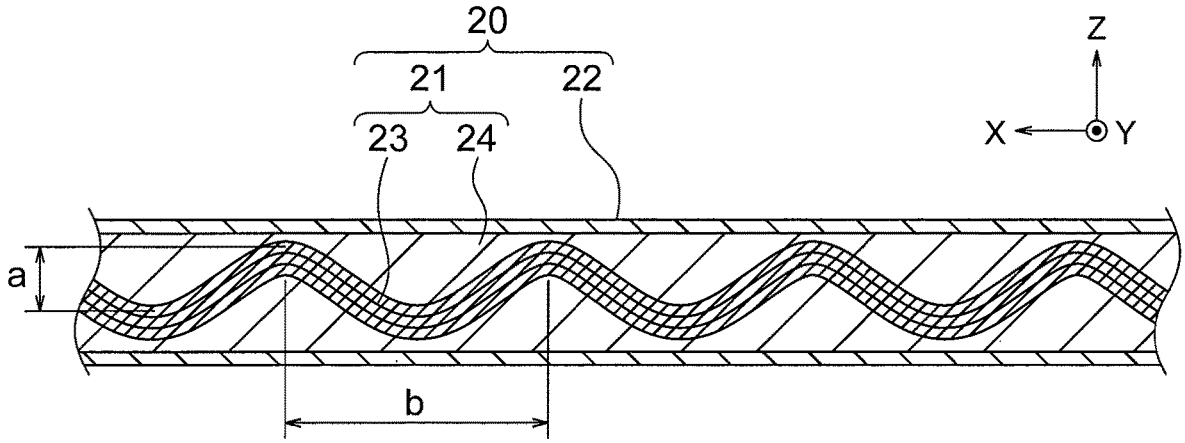
FIG. 4 is a B-B sectional view of FIG. 2.

FIG. 2 is a perspective view for illustrating a part of the rope 20 according to the first embodiment. FIG. 3 is an A-A sectional view of FIG. 2. FIG. 4 is a B-B sectional view of FIG. 2. In FIG. 2, an X-axis direction corresponds to a longitudinal direction of the rope 20, a Y-axis direction corresponds to a width direction of the rope 20, a Z-axis direction corresponds to a thickness direction of the rope 20, and L represents a length of the rope 20 in the X-axis direction. The same reference symbols are used also in subsequent drawings and description.

Moreover, in FIG. 2, a section of the rope 20 in the YZ plane along the line A-A is referred to as "A-A section", and a section of the rope 20 in the ZX plane along the line B-B is referred to as "B-B section". Similar sections are referred to as "A-A section" and "B-B section" also in subsequent drawings.

A load generated by the weight of, for example, the car 7 acts on the rope 20 in the X-axis direction. Moreover, the rope 20 is bent in a direction about the Y axis when the rope 20 passes on the drive sheave 5 and the deflector sheave 4.

The rope 20 according to the first embodiment includes a load supporting member 21, which is a main member, and a covering member 22, which covers an outer periphery of the load supporting member 21. As illustrated in FIG. 3, the shape of the rope 20 in the A-A section is a rectangular shape with a width-direction dimension larger than a thickness-direction dimension. Similarly, the shape of the load supporting member 21 in the A-A section is a rectangular shape with a width-direction dimension larger than a thickness-direction dimension.

The covering member 22 is configured to cover a periphery of the load supporting member 21 to protect the load supporting member 21 from an environmental load, such as heat and humidity which are applied from outside, and a physical load, which is applied due to contact with the drive sheave 5 and the deflector sheave 4. Moreover, the covering member 22 serves to stably provide traction required for the rope 20.

Further, it is desired that the covering member 22 have a high heat resistance and a high wear resistance. As a material of the covering member 22, there may be used, for example, polyurethane, epoxy, polyester, or vinyl ester. A friction coefficient of the rope 20 against the drive sheave 5 can be adjusted by changing the material of the covering member 22.

The load supporting member 21 includes a plurality of corrugated reinforcement fiber bundles 23, which are corrugated reinforcement fiber bodies, and an impregnation material 24. The corrugated reinforcement fiber bundles 23 are embedded in the impregnation material 24. Moreover, the corrugated reinforcement fiber bundles 23 are arranged continuously over the entirety of the load supporting member 21 in the longitudinal direction. The load which acts on the rope 20 in the longitudinal direction is supported mainly by the corrugated reinforcement fiber bundles 23.

The corrugated reinforcement fiber bundles 23 have a corrugated shape in a section parallel to the longitudinal direction. That is, the corrugated reinforcement fiber bundles 23 are corrugated in the B-B section of the rope 20. Moreover, the corrugated reinforcement fiber bundles 23 are cyclically curved along the longitudinal direction of the load supporting member 21 so as to protrude alternately toward one side and another side of the load supporting member 21 in the thickness direction.

Figure 5:
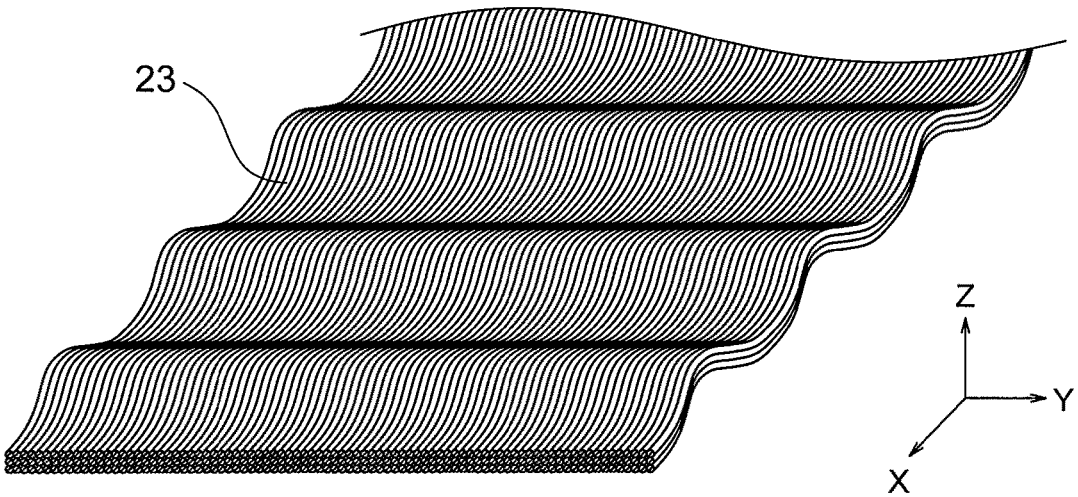
FIG. 5 is a perspective view for illustrating only corrugated reinforcement fiber bundles taken out from the rope of FIG. 2.

FIG. 5 is a perspective view for illustrating only the corrugated reinforcement fiber bundles 23 taken out from the rope 20 of FIG. 2. In the first embodiment, only the corrugated reinforcement fiber bundles 23 are used as the reinforcement fiber bodies. Moreover, all of the corrugated reinforcement fiber bundles 23 are corrugated in the same phase. The corrugated reinforcement fiber bundles 23 have such a length that a total length of the corrugated reinforcement fiber bundles 23, which is given when the corrugated reinforcement fiber bundles 23 are each straightened is equal to or larger than 1.1 times a total length of the load supporting member 21, that is, a length of the load supporting member 21 in the X-axis direction.

As illustrated in FIG. 4, when one corrugated reinforcement fiber bundle 23 is seen, in the thickness direction of the load supporting member 21, a difference in height in the Z-axis direction between a top point of a crest protruding toward one side and a top point of a crest protruding toward another side is represented by "a". Moreover, a distance in the X-axis direction between top points of adjacent crests protruding in the same direction is represented by "b". That is, the "b" represents a cycle of corrugation of the corrugated reinforcement fiber bundle 23. In the subsequent description, the height of the corrugation is represented by "a", and the cycle of the corrugation is represented by "b".

Figure 6:
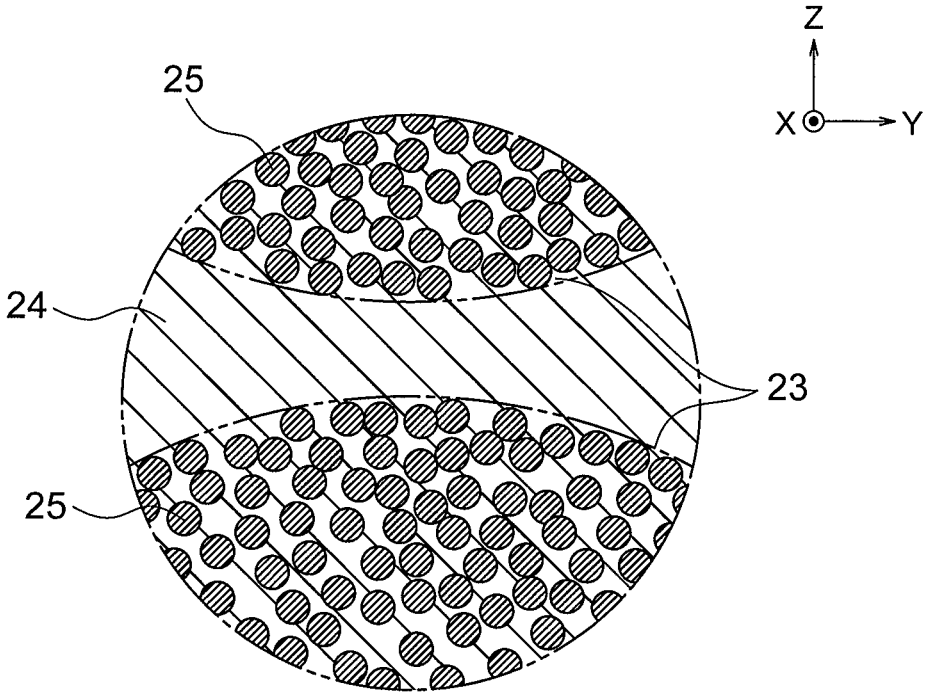
FIG. 6 is an enlarged sectional view for illustrating a part of a load supporting member of FIG. 3.

FIG. 6 is an enlarged sectional view for illustrating a part of the load supporting member 21 of FIG. 3. The corrugated reinforcement fiber bundles 23 are each formed of a plurality of continuous reinforcement fibers 25, which are bundled with each other and are light in weight and high in strength. As the reinforcement fibers 25, there are used, for example, carbon fibers, glass fibers, aramid fibers, PBO fibers, or composite fibers formed of a combination of those fibers.

The reinforcement fibers 25 in each corrugated reinforcement fiber bundle 23 are caused to adhere to one another by the impregnation material 24. Moreover, the corrugated reinforcement fiber bundles 23 are caused to adhere to one another by the impregnation material 24.

The impregnation material 24 prevents the reinforcement fibers 25 from being displaced inside the rope 20 during the use of the rope 20 and suppresses contact and wear of the reinforcement fibers 25, to thereby improve the lifetime of the rope 20.

The reinforcement fibers 25 each have an elastic modulus larger than elastic moduli of the impregnation material 24 and the covering member 22. Most of, specifically, 90% or more of the load which acts on the rope 20 in the X-axis direction by, for example, the weight of the car 7 and the own weight of the rope 20 is borne by the load supporting member 21, especially the reinforcement fibers 25.

Moreover, for example, when the rope 20 is bent along the outer periphery of the drive sheave 5, the rope 20 is caused to contract in the X-axis direction on the drive sheave 5 side and extend in the X-axis direction on the opposite side. The contraction amount and the extension amount given on this occasion are determined based on a curvature radius of the outer periphery of the drive sheave 5 and a thickness of the rope 20, and are larger at a position closer to the surface of the rope 20 in the Z-axis direction.

In order to allow the rope 20 to more easily bend, it is required to set a bending rigidity EI to be smaller. The bending rigidity EI is a value obtained by multiplying an equivalent elastic modulus E by a sectional secondary moment I of the rope 20 in the A-A section. The equivalent elastic modulus E is an elastic modulus, which is given with the assumption that the rope 20 is a homogenous body. Further, as a method of reducing the bending rigidity EI, there is known a method of setting the equivalent elastic modulus E to be small.

Among the elements of the rope 20, the reinforcement fibers 25 have the largest elastic modulus. The reinforcement fibers 25 are less likely to contract and extend, and hence a magnitude of the equivalent elastic modulus E of the rope 20 is mainly dependent on the reinforcement fibers 25. Therefore, when the contraction amount and the extension amount of the reinforcement fibers 25 with respect to the load are set larger, the equivalent elastic modulus E becomes smaller, thereby being capable of reducing the bending rigidity.

Moreover, when an elastic modulus at a position close to the surface of the rope 20 in the thickness direction, which requires a large contraction amount and a large extension amount when the rope 20 is bent along the drive sheave 5, is set smaller than a bending rigidity at the center of the rope 20 in the thickness direction, the bending rigidity can be effectively reduced.

Moreover, in addition to the method of reducing the equivalent elastic modulus E by causing the reinforcement fibers 25 to be likely to contract and extend, the bending rigidity EI can be reduced also by setting the sectional secondary moment I to be smaller.

In the case of the rectangular section of the homogenous body, the sectional secondary moment I of the rope 20 is expressed by the following Expression (1) using a width "w" and a thickness "t" of the rope 20.

$$I=wt^3/12 \quad (1)$$

The sectional secondary moment I is proportional to the width "w" and is proportional to the third power of the thickness "t". Therefore, when the thickness "t" is set to be smaller, the sectional secondary moment is effectively reduced, thereby being capable of setting the bending rigidity EI to be smaller.

As illustrated in FIG. 4 and FIG. 5, the rope 20 according to the first embodiment has such a structure that the corrugated reinforcement fiber bundles 23, that is, the reinforcement fibers 25 forming the corrugated reinforcement fiber bundles 23 are corrugated in the B-B section, to thereby cause the reinforcement fibers 25 to be longer than the case in which the reinforcement fibers 25 are oriented in parallel with the X-axis direction of the rope 20.

When the reinforcement fibers 25 are set longer, the contraction amount and the extension amount of the reinforcement fibers 25 increase even under the same load, thereby being capable of reducing the equivalent elastic modulus E of the rope 20. Moreover, in the XY section of the rope 20, at a position close to the surface of the rope 20 in the thickness direction, the ratio of the reinforcement fibers 25 is smaller than that at the center of the rope 20 in the thickness direction. Therefore, the elastic modulus at the position close to the surface can be further reduced. Therefore, the bending rigidity EI can be reduced so that the rope 20 can be bent more easily.

As described above, the rope 20 can be bent more easily. Therefore, the rope can be easily wound around the sheave such as the drive sheave 5 or the deflector sheave 4, and hence operability is excellent at the time of installation of the rope.

Moreover, with the reinforcement fibers 25 set longer, even when the contraction amount and the extension amount of the reinforcement fibers 25 are the same, distortion which may occur in the reinforcement fibers 25 at the time of winding of the rope 20 around the sheaves is reduced.

Further, the stress which may be generated in the reinforcement fibers 25 becomes smaller. Therefore, the reinforcement fibers 25 are less liable to be broken, thereby improving the strength reliability of the rope 20.

Furthermore, the installation workability and the strength reliability of the rope 20 are improved. Therefore, a curvature radius of outer peripheries of the sheaves around which the rope 20 is wound can be set smaller than that given in the case in which the reinforcement fibers 25 are arranged in parallel with the X-axis direction, thereby achieving space saving of the elevator.

Also in a general woven structure having wefts, fibers are slightly corrugated. However, a height "a" of corrugation is small, and the reinforcement fibers 25 do not significantly become longer with respect to the length L of the rope 20. As a result, the effect of the present invention cannot be attained.

As the length of the reinforcement fibers 25 is set larger with respect to the length L of the rope 20, the equivalent elastic modulus E of the rope 20 can be set smaller, thereby being capable of reducing the bending rigidity EI. In practice, it is desired that the bending rigidity of the rope 20 according to the present invention be reduced so as to be equal to or smaller than at least 0.9 times the bending rigidity given in the rope in which the reinforcement fibers 25 are oriented in parallel with the X-axis direction of the rope 20. Moreover, in a case in which consideration is made only on the effect of reducing the equivalent elastic modulus E through the increase in length of the reinforcement fibers 25, it is desired that the length of the reinforcement fibers 25 be equal to or larger than about 1.1 times the length L of the rope 20.

In order to set the length of the reinforcement fibers 25 to be larger with the corrugated shape, it is required that the height "a" of the corrugation be set larger with respect to the cycle "b" of the corrugation. For example, when the height "a" of the corrugation is set equal to or larger than ¼ times the thickness of the load supporting member 21 and equal to or larger than ⅙ times the cycle "b" of the corrugation, the length of the reinforcement fibers 25 can be equal to or larger than 1.1 times the length L of the rope 20.

Moreover, in the structure having a large height "a" of the corrugation in which the length of the reinforcement fibers 25 is equal to or larger than 1.1 times the length L of the rope 20, the ratio of the reinforcement fibers 25 is reduced at a position close to the surface of the rope 20 in the thickness direction in the XY section of the rope 20 as compared to the center of the rope 20 in the thickness direction. Therefore, the equivalent elastic modulus E can be further reduced, thereby being capable of effectively reducing the bending rigidity of the rope 20.

Moreover, the sectional shapes of the rope 20 and the load supporting member 21 are not limited to the rectangular shape. However, when the rope 20 and the load supporting member 21 each have a rectangular shape with a width-direction dimension larger than a thickness-direction dimension, a contact area with respect to the sheave is increased as compared to the case of a circular shape, thereby being capable of obtaining stable traction.

Further, the contact stress becomes smaller as the contact area with respect to the sheave increases, thereby being capable of reducing, for example, local deformation, damage, and wear of the rope 20 and the sheave.

Further, when the same sectional area is given, with the rectangular sectional shape, the thickness dimension of the rope can be set smaller than that given in the case of the circular sectional shape, thereby being capable of effectively reducing the bending rigidity.

Moreover, as the thickness of the rope 20 is set smaller, the stress generated in members forming the rope 20 is reduced, thereby improving the strength reliability of the rope 20.

Further, when the corrugated reinforcement fiber bundles 23 are to be used, the bending rigidity can be adjusted by changing the cycle and amplitude of the corrugation. For example, when the cycle of the corrugation is set smaller, or the amplitude of the corrugation is set larger, the length of the corrugated reinforcement fiber bundles 23 increases, thereby being capable of reducing the bending rigidity.

The corrugated shape of the corrugated reinforcement fiber bundles 23 can be achieved, for example, by winding the reinforcement fiber bundles in a corrugated shape around a plurality of circular rods made of the same material as the impregnation material 24 and, in this state, allowing the impregnation material 24 to impregnate thereinto.

Moreover, in the first embodiment, all of the reinforcement fiber bodies are formed of the corrugated reinforcement fiber bundles 23. However, reinforcement fiber bodies other than the corrugated reinforcement fiber bundles 23 may be mixed.

Further, as the material of the impregnation material 24, there may be used, for example, polyurethane, epoxy, polyester, vinyl ester, or phenol resin, and it is desired that the material be excellent in adhesion characteristic with respect to the reinforcement fibers 25. Moreover, when a material having a small elastic modulus is used as the material of the impregnation material 24, the bending rigidity of the rope 20 can be set smaller. Meanwhile, when a material having a large elastic modulus is used as the material of the impregnation material 24, the load acting on the reinforcement fibers 25 is evenly distributed, thereby being capable of reducing unevenness in strength of the rope 20.

Second Embodiment

Figure 7:
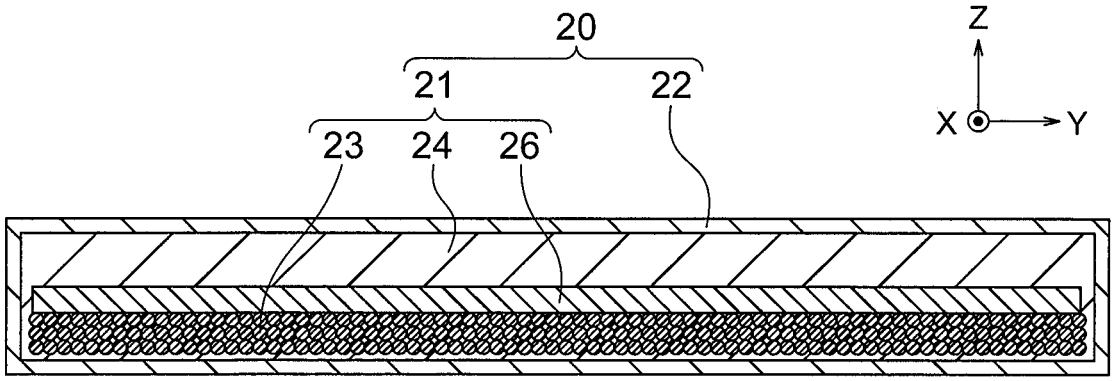
FIG. 7 is an A-A sectional view of FIG. 2 of the rope according to a second embodiment of this invention.
Figure 8:
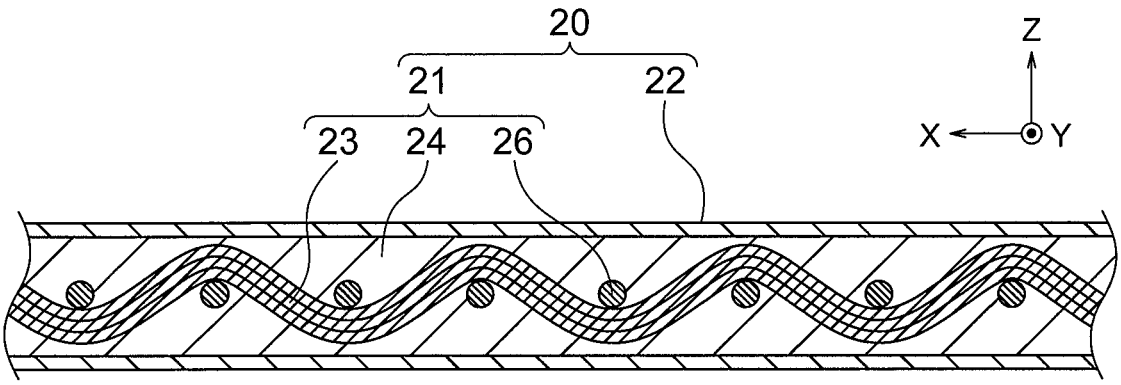
FIG. 8 is a B-B sectional view of FIG. 2 of the rope of FIG. 7.

Next, FIG. 7 is an A-A sectional view of FIG. 2 of the rope 20 according to a second embodiment of this invention. FIG. 8 is a B-B sectional view of FIG. 2 of the rope 20 of FIG. 7. The load supporting member 21 in the second embodiment further includes a plurality of rod-shaped cross members 26. The cross members 26 are spaced apart from each other in the longitudinal direction of the load supporting member 21 and are embedded in the impregnation material 24.

Moreover, the cross members 26 are arranged in parallel with each other and in parallel with the Y-axis direction. Further, the cross members 26 each have an elongated shape extending in a direction perpendicular to the longitudinal direction of the load supporting member 21. Furthermore, the cross members 26 each have a circular sectional shape. The cross members 26 each have an elastic modulus larger than an elastic modulus of the impregnation material 24. Moreover, it is desired that the cross members 26 be prevented from being plastically deformed by a load in the Z-axis direction, which is applied from the corrugated reinforcement fiber bundles 23 to the cross members 26 when the load in the X-axis direction acts on the rope 20.

As the material of the cross member 26, there may be given, for example, an iron-based material, a non-ferrous-based metal material, glass, or ceramic. Examples of the iron-based material include carbon steel, high-tensile steel, rolled steel, stainless steel, and structural alloy steel. In addition, examples of the non-ferrous-based metal material include materials, such as aluminum, magnesium, titanium, brass, and copper, and alloy materials.

Figure 9:
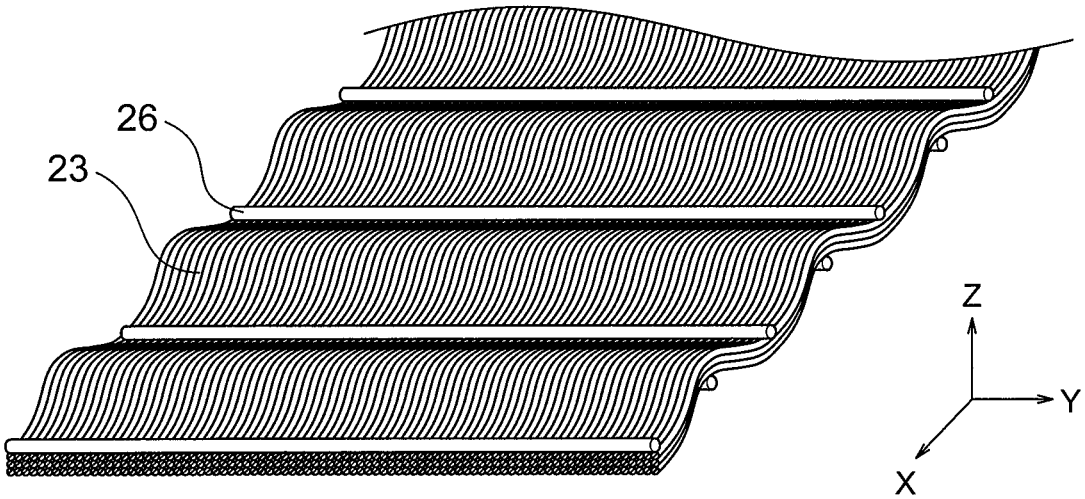
FIG. 9 is a perspective view for illustrating only the corrugated reinforcement fiber bundles and cross members taken out from the rope of FIG. 7.

FIG. 9 is a perspective view for illustrating only the corrugated reinforcement fiber bundles 23 and the cross members 26 taken out from the rope 20 of FIG. 7. The corrugated reinforcement fiber bundles 23 are wound alternately on one side and another side of the cross members 26 in the thickness direction of the load supporting member 21 to form the corrugated shape. With this configuration, the corrugated reinforcement fiber bundles 23 have such a length that a total length of the corrugated reinforcement fiber bundles 23, which is given when the corrugated reinforcement fiber bundles 23 are straightened is larger than a total length of the load supporting member 21.

Moreover, the cross members 26 each have a longitudinal-direction dimension which matches with a width-direction dimension of the load supporting member 21. Further, in this example, all of the cross members 26 are arranged at the same position in the thickness direction of the load supporting member 21. Other configurations are similar or identical to those of the first embodiment.

The load supporting member 21 is produced, under a state in which the corrugated reinforcement fiber bundles 23 are wound around the cross members 26, by allowing the impregnation material 24 to impregnate among the reinforcement fibers 25, among the corrugated reinforcement fiber bundles 23, and among the corrugated reinforcement fiber bundles 23 and the cross members 26. On this occasion, the cross members 26 are caused to adhere to the corrugated reinforcement fiber bundles 23 by the impregnation material 24.

Even with such a configuration, similarly to the first embodiment, the bending rigidity can be reduced while achieving the increase in strength and reduction in weight.

Moreover, when the load in the X-axis direction acts on the rope 20, a force in the Z-axis direction which is generated in the corrugated reinforcement fiber bundles 23 is received by the cross members 26, thereby being capable of reducing the extension of the rope 20 in the X-axis direction.

Further, at the time of production of the load supporting member 21, displacement of the corrugated reinforcement fiber bundles 23 is prevented, thereby being capable of stabilizing the mechanical characteristics of the rope 20. At the time of production of the load supporting member 21, when the load in the X-axis direction is caused to act on the corrugated reinforcement fiber bundles 23, the displacement of the corrugated reinforcement fiber bundles 23 can be further suppressed, thereby being capable of reducing the extension when the load acts on the rope 20 in the X-axis direction.

The shape of the cross members 26 is not particularly limited. However, when a sectional area of the cross member 26 at a position at which the corrugated reinforcement fiber bundles 23 are wound therearound in the B-B section is larger than a sectional area of each of the corrugated reinforcement fiber bundles 23 in the A-A section, the length of the corrugated reinforcement fiber bundles 23 can be effectively increased.

Moreover, the length of the reinforcement fibers 25 with respect to the rope 20 can be adjusted by changing a sectional area of the cross members 26 in the B-B section, that is, a sectional area of a section perpendicular to the longitudinal direction of the cross members 26.

Further, when the cross members 26 each have a circular sectional shape in the B-B section, local contact with the corrugated reinforcement fiber bundles 23 can be avoided, thereby being capable of preventing damage on the corrugated reinforcement fiber bundles 23 due to excessive stress concentration.

Figure 10:
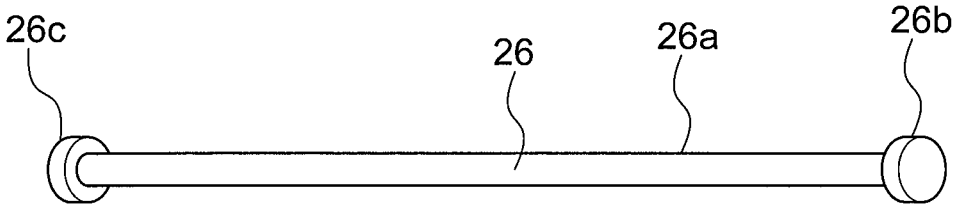
FIG. 10 is a perspective view for illustrating a modification example of the cross member.

FIG. 10 is a perspective view for illustrating a modification example of the cross member 26. In this example, the cross member 26 includes a cross member main body **26*a* having a circular rod shape, a first flange portion 26*b* provided at a first end portion of the cross member main body 26*a* in the longitudinal direction, and a second flange portion 26*c* provided at a second end portion of the cross member main body 26*a* in the longitudinal direction. The first flange portion 26*b* and the second flange portion 26*c* each have a diameter larger than a diameter of the cross member main body 26*a***.

When such cross members 26 are used, expansion and protrusion of the corrugated reinforcement fiber bundles 23 in the Y-axis direction at the time of manufacture can be suppressed.

Moreover, grooves configured to receive the corrugated reinforcement fiber bundles 23 to be inserted thereinto may be formed in outer peripheral surfaces of the cross members 26. With this, displacement of the corrugated reinforcement fiber bundles 23 at the time of manufacture can be suppressed.

Further, an outer periphery of each of the cross members 26 may be covered in advance with a material which is the same as or different from that of the impregnation material 24. With this, coating is subjected among the corrugated reinforcement fiber bundles 23 and the cross members 26, thereby being capable of reliably preventing direct contact of the corrugated reinforcement fiber bundles 23 with respect to the cross members 26.

Furthermore, the intervals of the cross members 26 in the X-axis direction may be constant or may be not-constant. For example, the cross members 26 may be arranged only at portions at which the rope 20 passes on the sheaves. At portions at which the rope 20 does not pass on the sheaves, the cross members 26 may be omitted, and the reinforcement fiber bundles may be arranged in parallel with the X-axis direction. With this, the extension of the rope 20 in the X-axis direction when the load in the X-axis direction acts on the rope 20 can be reduced.

Moreover, it is not always required that the cross members 26 be arranged at the same position in the thickness direction of the load supporting member 21.

Further, the orientation of the cross members 26 is not limited to the Y-axis direction, and the cross members 26 may be arranged, for example, in parallel with the Z-axis direction. In this case, the corrugated reinforcement fiber bundles 23 have a corrugated shape when the section parallel to the XY plane is viewed. However, as illustrated in FIG. 6 to FIG. 9, when the cross members 26 are arranged in parallel with the Y-axis direction, and the corrugated reinforcement fiber bundles 23 are wound in the corrugated shape in the B-B section, the reinforcement fibers 25 arranged closer to the surface of the rope 20 in the Z-axis direction are more likely to contract and extend, thereby being capable of effectively reducing the bending rigidity of the rope 20.

Furthermore, the corrugated reinforcement fiber bundles 23 may have such a length that a total length thereof given when the corrugated reinforcement fiber bundles 23 are straightened is larger than 1 time and smaller than 1.1 times the total length of the load supporting member 21. However, it is particularly preferred that, similarly to the first embodiment, the corrugated reinforcement fiber bundles 23 have such a length that a total length thereof is equal to or larger than 1.1 times the total length of the load supporting member 21. With this, the bending rigidity of the rope 20 can be effectively reduced.

Third Embodiment

Figure 11:
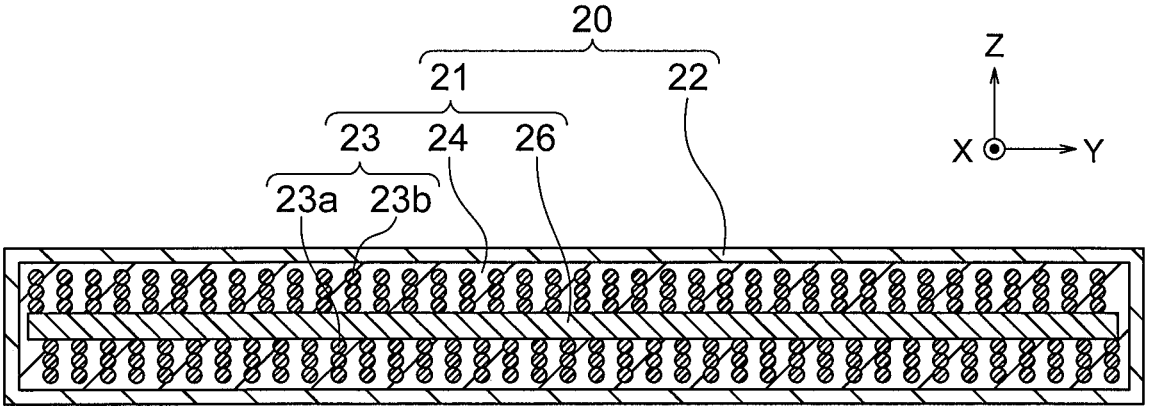
FIG. 11 is an A-A sectional view of FIG. 2 of the rope according to a third embodiment of this invention.
Figure 12:
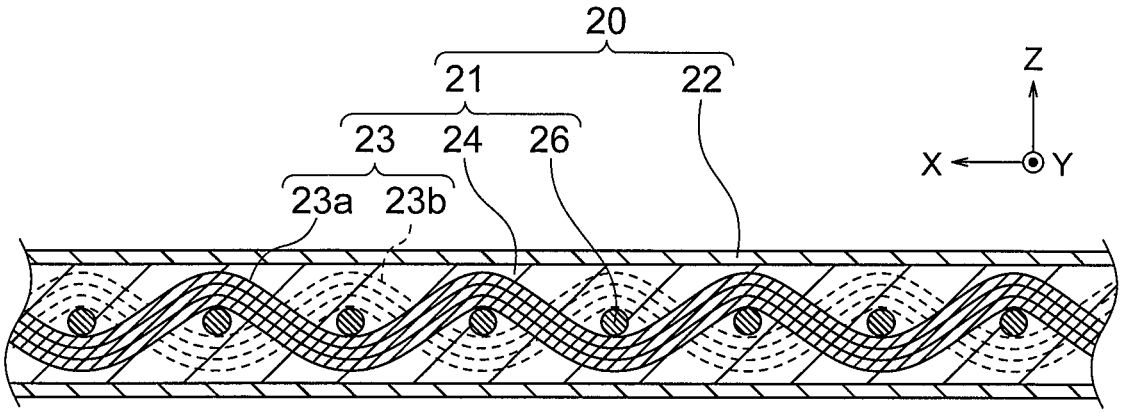
FIG. 12 is a B-B sectional view of FIG. 2 of the rope of FIG. 11.
Figure 13:
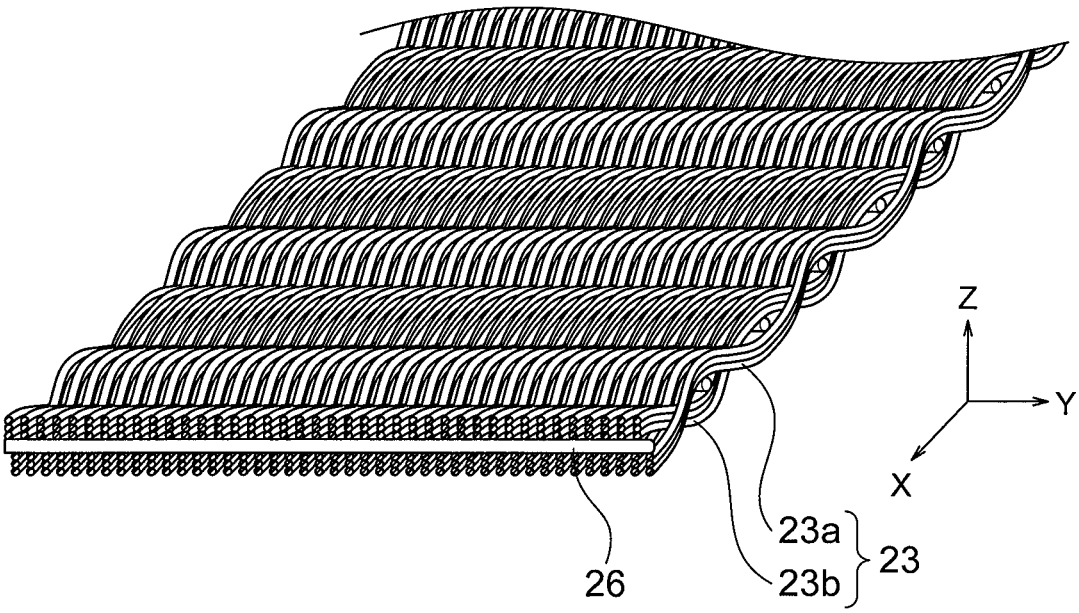
FIG. 13 is a perspective view for illustrating only the corrugated reinforcement fiber bundles and the cross members taken out from the rope of FIG. 11.

Next, FIG. 11 is an A-A sectional view of the rope 20 according to a third embodiment of this invention. FIG. 12 is a B-B sectional view of the rope 20 of FIG. 11. FIG. 13 is a perspective view for illustrating only the corrugated reinforcement fiber bundles 23 and the cross members 26 taken out from the rope 20 of FIG. 11.

In the third embodiment, the corrugated reinforcement fiber bundles 23 are divided into a plurality of groups arrayed in the width direction of the load supporting member 21. The corrugated reinforcement fiber bundles 23 in the groups adjacent to each other in the width direction of the load supporting member 21 are deviated by 180° in phase in the longitudinal direction of the load supporting member 21 and are wound around the cross members 26.

In this example, the corrugated reinforcement fiber bundles 23 are divided into different groups each including one corrugated reinforcement fiber bundle 23. Therefore, the corrugated reinforcement fiber bundles 23 adjacent to each other in the width direction of the load supporting member 21 form corrugation in which the phases in the longitudinal direction of the load supporting member 21 are deviated from each other by 180°.

That is, in the rope 20 illustrated in FIG. 6 to FIG. 9, all of the corrugated reinforcement fiber bundles 23 are in the same phase in the X-axis direction. In contrast, in the rope 20 illustrated in FIG. 11 to FIG. 13, the corrugated reinforcement fiber bundles 23*a* and the corrugated reinforcement fiber bundles 23*b* adjacent to each other in the Y-axis direction are wound around the cross members 26 so as to be corrugated in the B-B section in a state of being deviated in phase by 180° in the X-axis direction. Other configurations are similar or identical to those of the second embodiment.

Even with such a configuration, similarly to the second embodiment, the bending rigidity can be reduced while achieving the increase in strength and reduction in weight.

Moreover, as the corrugated reinforcement fiber bundles 23*a* and 23*b* adjacent to each other are deviated by 180° in phase, when the load acts on the rope 20 in the X-axis direction, a force acting on the cross members 26 in the Z-axis direction from the corrugated reinforcement fiber bundles 23*a* and a force acting on the cross members 26 in the Z-axis direction from the corrugated reinforcement fiber bundles 23*b* can be directed in opposite directions.

With this, the forces generally acting on the cross members 26 in the Z-axis direction can be balanced, and movement of the corrugated reinforcement fiber bundles 23 in the Z-axis direction can be suppressed when the load acts on the rope 20. Moreover, extension of the corrugated reinforcement fiber bundles 23 in the X-axis direction due to the action of the load, that is, the extension of the rope 20 in the X-axis direction with respect to the load can be reduced.

In FIG. 6 to FIG. 9 and FIG. 11 to FIG. 13, the corrugated reinforcement fiber bundles 23 are stacked in three layers in the Z-axis direction. However, the number of layers of the corrugated reinforcement fiber bundles 23 is not limited to three. The number of layers may be only one or two, or may be equal to or more than four. With the configuration in which the corrugated reinforcement fiber bundles 23 are stacked in two or more layers in the Z-axis direction so that the positions of the corrugated reinforcement fiber bundles 23 to be wound around the cross members 26 are increased in the Z-axis direction in the A-A section, the length of the reinforcement fibers 25 can be gained even when the diameter of each of the cross members 26 is small, thereby being capable of effectively reducing the bending rigidity.

Moreover, in the third embodiment, the corrugated reinforcement fiber bundles 23 are divided into different groups each including one corrugated reinforcement fiber bundle 23. However, each group may include two or more corrugated reinforcement fiber bundles 23.

Fourth Embodiment

Figure 14:
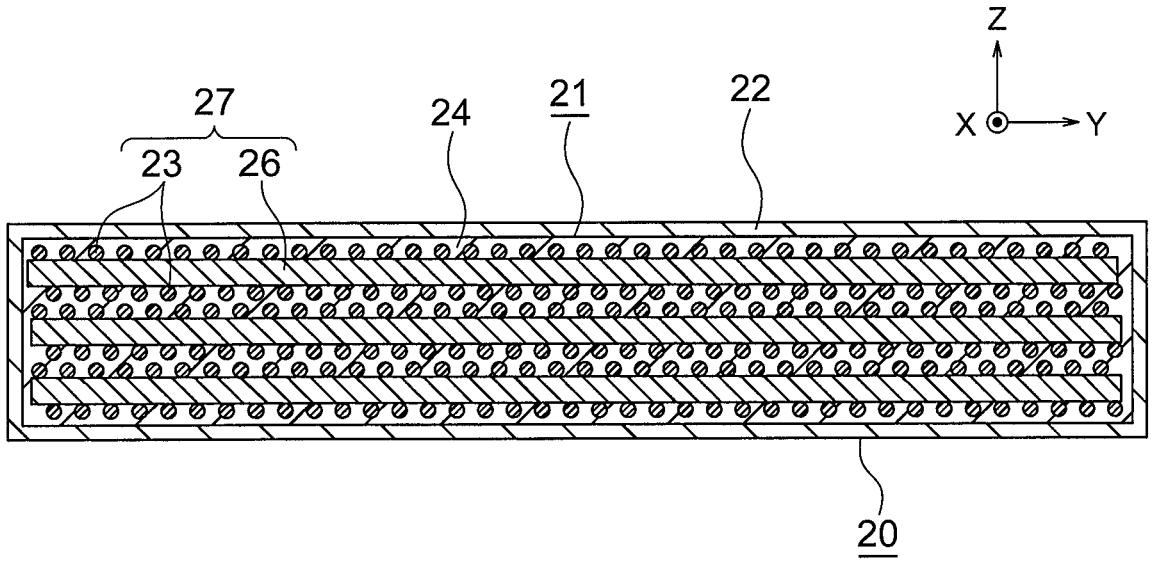
FIG. 14 is an A-A sectional view of FIG. 2 of the rope according to a fourth embodiment of this invention.
Figure 15:
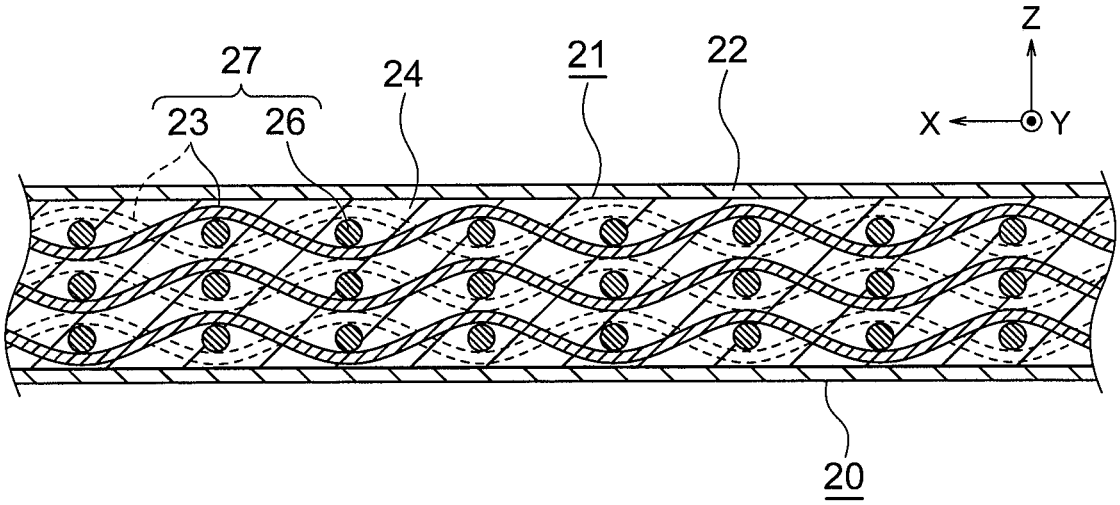
FIG. 15 is a B-B sectional view of FIG. 2 of the rope of FIG. 14.
Figure 16:
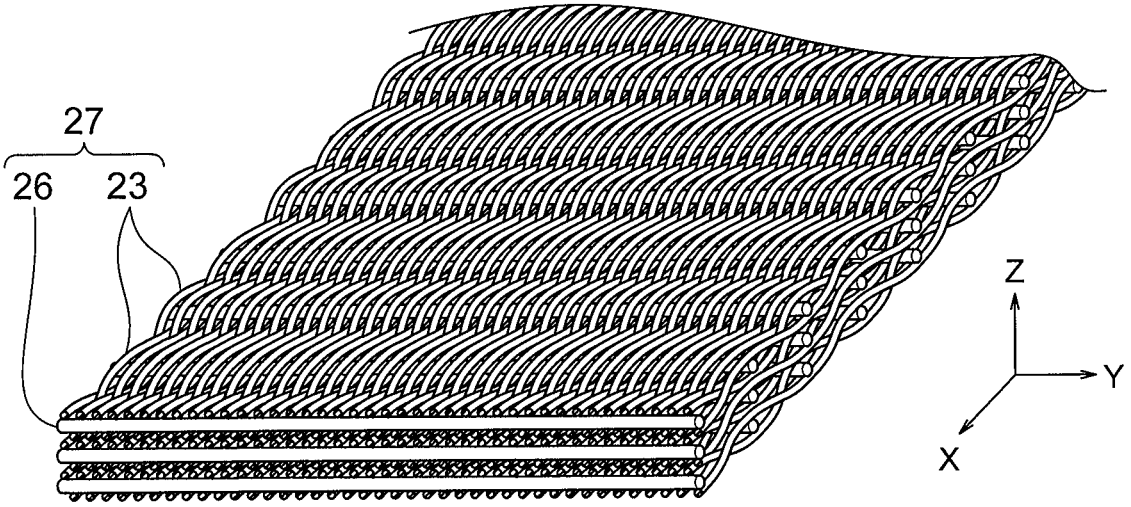
FIG. 16 is a perspective view for illustrating only the corrugated reinforcement fiber bundles and the cross members taken out from the rope of FIG. 14.

Next, FIG. 14 is an A-A sectional view of FIG. 2 of the rope 20 according to a fourth embodiment of this invention. FIG. 15 is a B-B sectional view of FIG. 2 of the rope 20 of FIG. 14. FIG. 16 is a perspective view for illustrating only the corrugated reinforcement fiber bundles 23 and the cross members 26 taken out from the rope 20 of FIG. 14.

In the fourth embodiment, a plurality of composite layers 27 each including a plurality of corrugated reinforcement fiber bundles 23 and a plurality of cross members 26 are arrayed in the thickness direction of the load supporting member 21. In this example, the composite layers 27 are stacked in three layers in the thickness direction of the load supporting member 21.

In each of the composite layers 27, the corrugated reinforcement fiber bundles 23 are arranged in only one layer in the Z-axis direction. Moreover, in each of the composite layers 27, the corrugated reinforcement fiber bundles 23 are divided into a plurality of groups in the width direction of the load supporting member 21.

Further, in each of the composite layers 27, the corrugated reinforcement fiber bundles 23 in the groups adjacent to each other in the width direction of the load supporting member 21 are wound around the cross members 26 so as to be corrugated while being deviated from each other by 180° in phase in the longitudinal direction of the load supporting member 21. The composite layers 27 are caused to adhere to one another by the impregnation material 24. Other configurations are similar or identical to those of the third embodiment.

Even with such a configuration, similarly to the third embodiment, the bending rigidity can be reduced while achieving the increase in strength and reduction in weight.

Moreover, in the rope 20 according to the fourth embodiment, the number of the cross members 26 per unit length of the X-axis direction is large. Thus, the effect of suppressing the displacement of the corrugated reinforcement fiber bundles 23, which may occur during manufacture of the rope 20, is significant. Therefore, the rope 20 with stable mechanical characteristics can be obtained.

Further, in each of the composite layers 27, the corrugated reinforcement fiber bundles 23 adjacent to each other are deviated by 180° in phase. Therefore, similarly to the third embodiment, the movement of the corrugated reinforcement fiber bundles 23 in the Z-axis direction when the load acts on the rope 20 can be suppressed.

A layer distance between the composite layers 27 adjacent to each other in the Z-axis direction, the phase in the X-axis direction, and the number of the composite layers 27 are not particularly limited.

Figure 17:
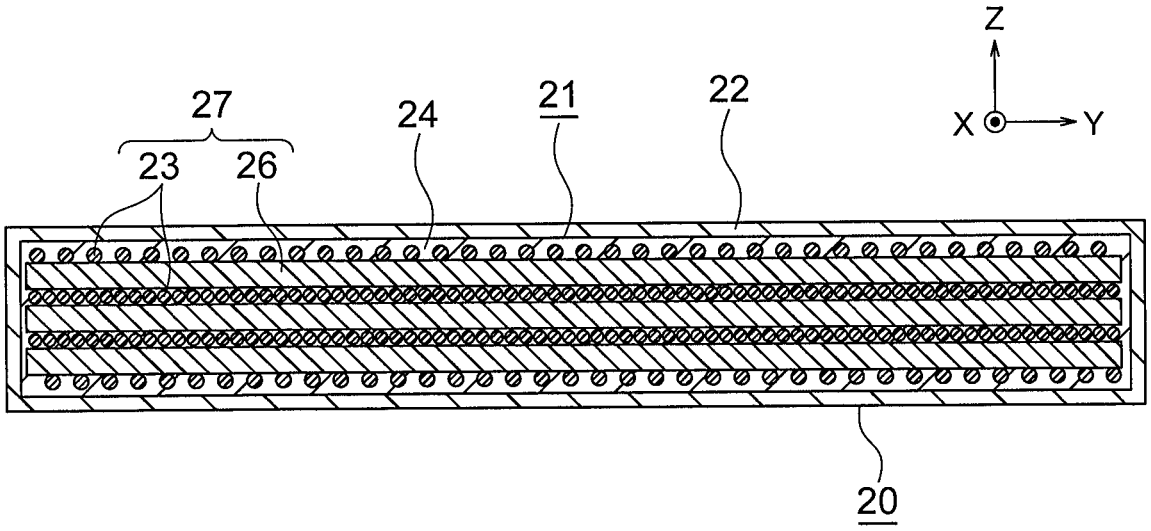
FIG. 17 is an A-A sectional view of FIG. 2 for illustrating a first modification example of the rope according to the fourth embodiment.
Figure 18:
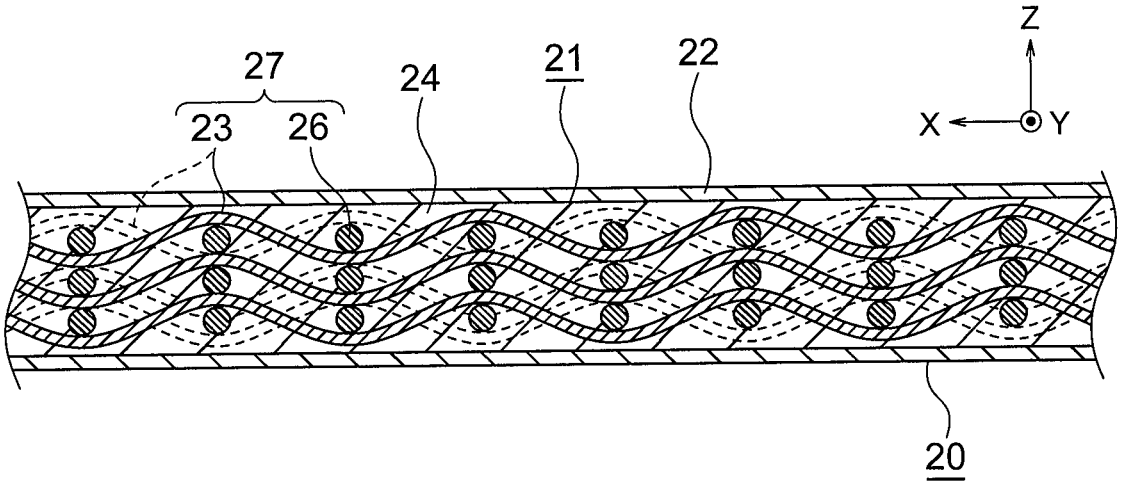
FIG. 18 is a B-B sectional view of FIG. 2 of the rope of FIG. 17.

Moreover, FIG. 17 is an A-A sectional view of FIG. 2 for illustrating a first modification example of the rope 20 according to the fourth embodiment. FIG. 18 is a B-B sectional view of FIG. 2 of the rope 20 of FIG. 17. In this example, the layer distance between the composite layers 27 is set small, and the corrugated reinforcement fiber bundles 23 of the composite layers 27 adjacent to each other in the Z-axis direction are provided between the corrugated reinforcement fiber bundles 23 adjacent to each other in the Y-axis direction.

With such a configuration, the dimension of the rope 20 in the Z-axis direction, that is, the thickness dimension can be set smaller without reducing the number of the corrugated reinforcement fiber bundles 23. That is, a strength-to-weight ratio of the rope 20 with respect to the A-A sectional area can be increased.

Figure 19:
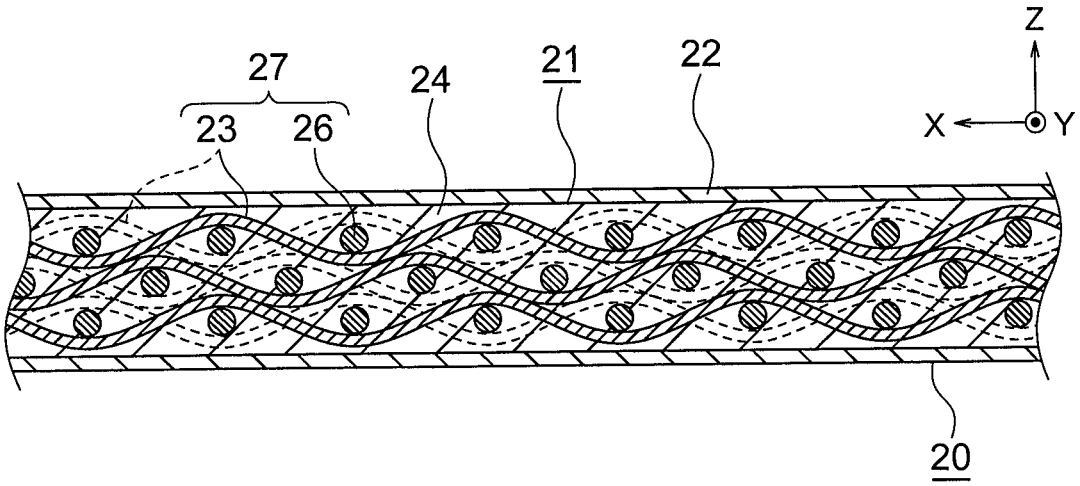
FIG. 19 is a B-B sectional view of FIG. 2 for illustrating a second modification example of the rope according to the fourth embodiment.

Further, FIG. 19 is a B-B sectional view of FIG. 2 for illustrating a second modification example of the rope 20 according to the fourth embodiment. In this example, among the three composite layers 27 stacked in the Z-axis direction, only the corrugated reinforcement fiber bundles 23 of the composite layer 27 in the middle are deviated by 90° in phase in the X-axis direction with respect to the corrugated reinforcement fiber bundles 23 of other composite layers 27. Moreover, the corrugated reinforcement fiber bundles 23 of the composite layers 27 adjacent to each other are brought as close as possible to each other in the Z-axis direction, to thereby reduce the layer distance between the composite layers 27.

With such a configuration, the layer distance can be further reduced. Therefore, the thickness dimension of the rope 20 in the Z-axis direction may be further reduced to further increase the strength-to-weight ratio of the rope 20 with respect to the A-A sectional area.

Fifth Embodiment

Figure 20:
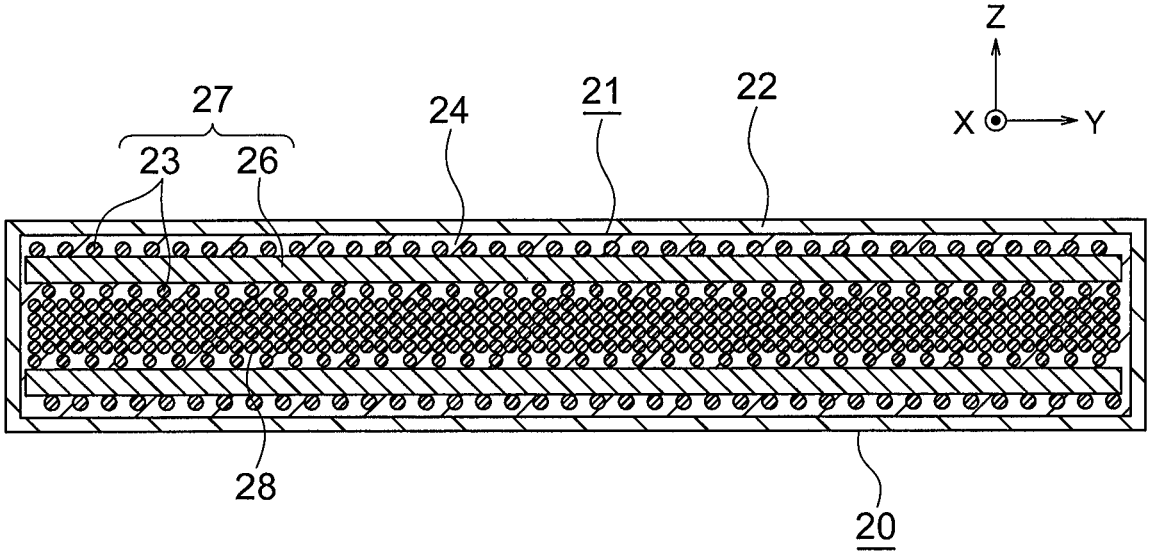
FIG. 20 is an A-A sectional view of FIG. 2 of the rope according to a fifth embodiment of this invention.
Figure 21:
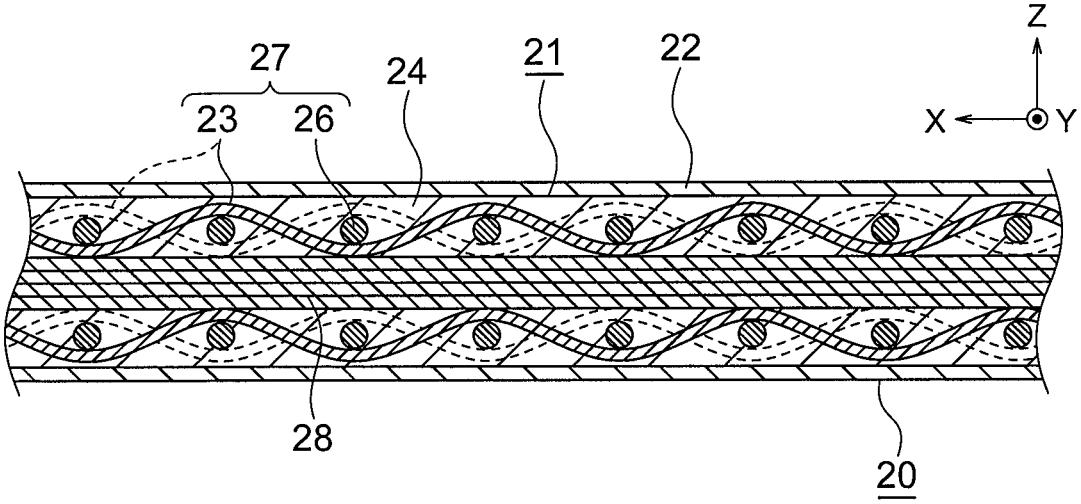
FIG. 21 is a B-B sectional view of FIG. 2 of the rope of FIG. 20.

Next, FIG. 20 is an A-A sectional view of FIG. 2 of the rope 20 according to a fifth embodiment of this invention. FIG. 21 is a B-B sectional view of FIG. 2 of the rope 20 of FIG. 20. In the fifth embodiment, a plurality of parallel reinforcement fiber bundles 28 being the parallel reinforcement fiber bodies are arranged at the center of the load supporting member 21 in the thickness direction. The parallel reinforcement fiber bundles 28 are bundles of the reinforcement fibers 25 arranged in parallel to the longitudinal direction of the load supporting member 21.

Moreover, the parallel reinforcement fiber bundles 28 are arranged continuously over the entirety of the load supporting member 21 in the longitudinal direction. That is, the reinforcement fiber bodies in the fifth embodiment include the corrugated reinforcement fiber bundles 23 and the parallel reinforcement fiber bundles 28.

Further, the parallel reinforcement fiber bundles 28 are arranged without any gap in the Y-axis direction and the Z-axis direction when viewed on the A-A section. In FIG. 20, the parallel reinforcement fiber bundles 28 are arranged in four layers in the Z-axis direction.

On both sides of the layer of the parallel reinforcement fiber bundles 28 in the thickness direction of the load supporting member 21, there are arranged the composite layers 27, respectively. That is, the layer of the parallel reinforcement fiber bundles 28 is sandwiched between the composite layers 27 in the Z-axis direction.

Figure 22:
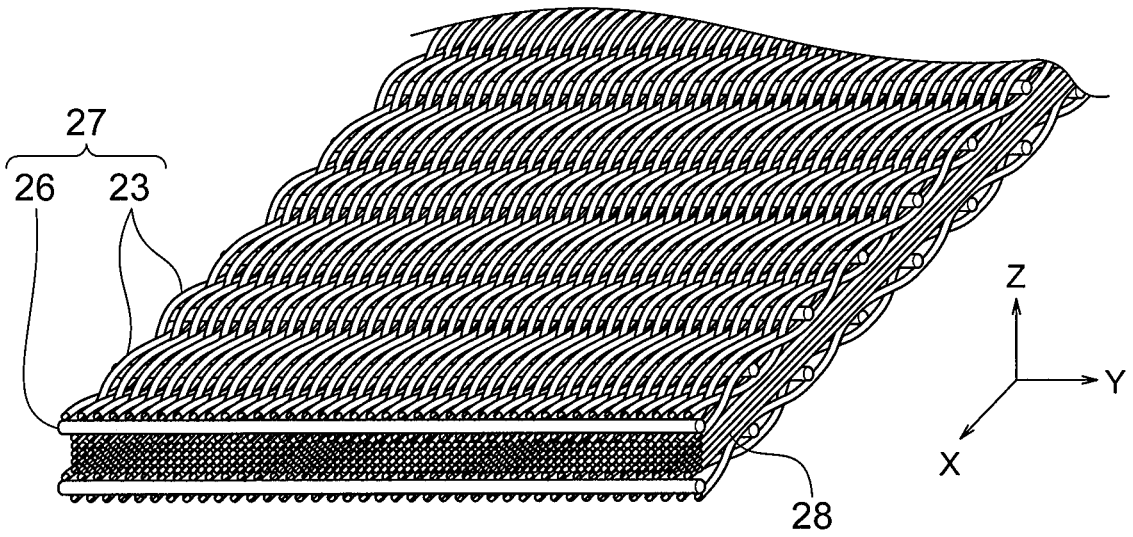
FIG. 22 is a perspective view for illustrating only the corrugated reinforcement fiber bundles, parallel reinforcement fiber bundles, and the cross members taken out from the rope of FIG. 20.

FIG. 22 is a perspective view for illustrating only the corrugated reinforcement fiber bundles 23, the parallel reinforcement fiber bundles 28, and the cross members 26 taken out from the rope 20 of FIG. 20. The fifth embodiment has a configuration in which the composite layer 27 of the fourth embodiment located in the middle in the Z-axis direction is replaced with the layer of the parallel reinforcement fiber bundles 28, and other configurations are similar or identical to those of the fourth embodiment.

Even with such a configuration, similarly to the second embodiment, the bending rigidity can be reduced while achieving the increase in strength and the reduction in weight. That is, in the vicinity of the surface in the Z-axis direction which requires the contraction amount and the extension amount at the time of bending of the rope 20, the corrugated reinforcement fiber bundles 23 are arranged, thereby being capable of reducing the bending rigidity of the rope 20.

Meanwhile, in the vicinity of the middle in the Z-axis direction which does not require much contraction amount and extension amount at the time of bending of the rope 20, the parallel reinforcement fiber bundles 28 are arranged, thereby being capable of increasing the content ratio of the reinforcement fibers 25 bearing the load in the X-axis direction in the rope 20. Therefore, the strength-to-weight ratio with respect to the A-A sectional area can be increased.

In the fifth embodiment, the number of layers of the parallel reinforcement fiber bundles 28 in the Z-axis direction is not particularly limited.

Sixth Embodiment

Figure 23:
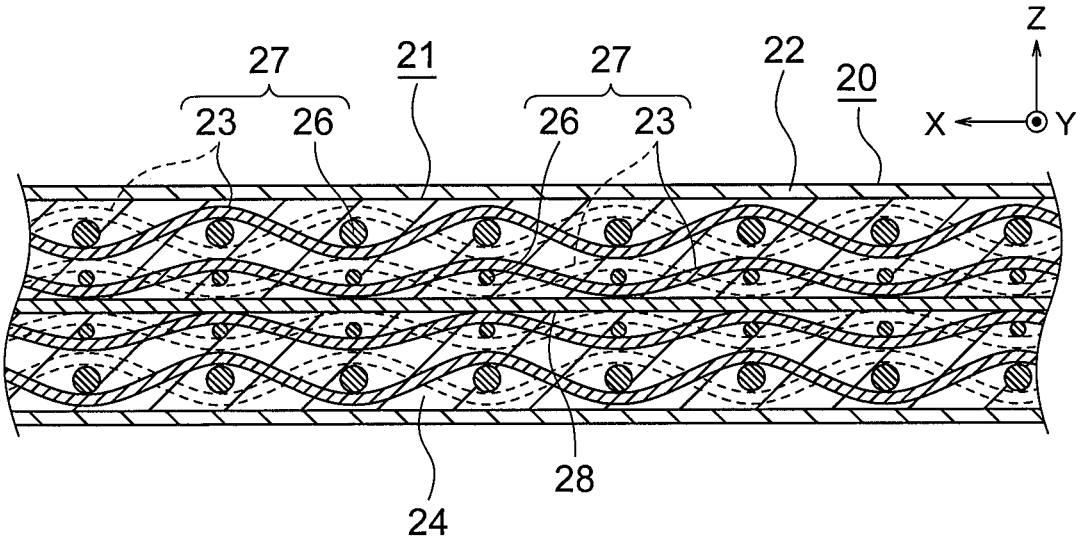
FIG. 23 is a B-B sectional view of FIG. 2 of the rope according to a sixth embodiment of this invention.

Next, FIG. 23 is a B-B sectional view of FIG. 2 of the rope 20 according to a sixth embodiment of this invention. In the sixth embodiment, the composite layers 27 are arrayed in four layers in the Z-axis direction. Moreover, in the middle in the Z-axis direction, the parallel reinforcement fiber bundles 28 are arranged in one layer in the Z-axis direction.

Among the composite layers 27, a diameter of each of the cross members 26 in two composite layers 27 located close to the surface of the load supporting member 21 in the Z-axis direction is larger than a diameter of each of the cross members 26 in two composite layers 27 located far from the surface. Conversely, a diameter of each of the cross members 26 in the composite layers 27 far from the surface is smaller than a diameter of each of the cross members 26 in the composite layers 27 located close to the surface.

With this, a height of the corrugation, that is, an amplitude of the corrugated reinforcement fiber bundles 23 in the composite layers 27 located close to the surface is larger than an amplitude of the corrugation of the corrugated reinforcement fiber bundles 23 in the composite layers 27 far from the surface. With this, the composite layers 27 closer to the surface of the load supporting member 21 in the thickness direction have a larger total length, which is given when the corrugated reinforcement fiber bundles 23 are straightened. Other configurations are similar or identical to those of the fifth embodiment.

Even with such a configuration, similarly to the fifth embodiment, the bending rigidity can be reduced while achieving the increase in strength and the reduction in weight. Moreover, the bending rigidity of the rope 20 can be effectively reduced with respect to the strength of the rope 20 in the X-axis direction.

Moreover, with an elevator, to which the rope 20 according to the first to sixth embodiments is applied, the reliability of the rope 20 can be sufficiently secured while coping with the increase in high lift. Further, the ease of installation of the rope 20 with respect to the sheaves such as the drive sheave 5 can be improved.

In the rope 20 according to the fourth and fifth embodiments, the elastic modulus of the corrugated reinforcement fiber bundles 23 in the composite layers 27 located close to the surface may be set smaller than that of the corrugated reinforcement fiber bundles 23 or the parallel reinforcement fiber bundles 28 in the composite layers 27 located close to the center in the Z-axis direction. With this arrangement, the corrugated reinforcement fiber bundles 23 can easily contract or extend, thereby being capable of reducing the bending rigidity of the rope 20.

The reduction in elastic modulus of the corrugated reinforcement fiber bundles 23 can be achieved, for example, by reducing a fiber density of the reinforcement fibers 25 in the corrugated reinforcement fiber bundles 23 or by using the reinforcement fibers 25 having a small elastic modulus. Moreover, the fiber density of the reinforcement fibers 25 in the corrugated reinforcement fiber bundles 23 can be reduced, for example, by reducing the number of the reinforcement fibers 25 to be used for the corrugated reinforcement fiber bundles 23 or by using thin fibers without changing the number of fibers.

In the first to sixth embodiments, the surface of the rope 20 is flat. However, for example, irregularities such as grooves or projections may be formed on a contact surface between the rope 20 and the sheave to increase the contact area between the rope 20 and the sheave.

Moreover, when the irregularities along the Y-axis direction are formed on the rope 20 and the sheave so that the irregularities formed on the rope 20 and the sheave mesh with each other, sliding of the rope 20 with respect to the sheave can be more reliably suppressed.

Further, the arrangement method, the configuration, and the number of the corrugated reinforcement fiber bundles 23 are not limited to those of the examples in the first to sixth embodiments.

Furthermore, in the first to sixth embodiments, the corrugated reinforcement fiber bundles 23 are not limited to have the corrugation with the constant cycle, and may have corrugation with a non-constant cycle. For example, at least one of the amplitude or the cycle of the corrugation may be changed depending on the position of the rope 20 in the longitudinal direction. Moreover, the reinforcement fiber bundles may be corrugated only at portions at which the rope passes on the sheave during the use, and the reinforcement fiber bundles may be arranged in parallel to the X-axis direction at the portions at which the rope does not pass on the sheave. In this case, the extension of the portions of the reinforcement fiber bundles arranged in parallel to the X-axis direction when the load in the X-axis direction acts on the rope 20 becomes smaller than the extension of the corrugated portions of the reinforcement fiber bundles, thereby being capable of generally reducing the extension of the rope 20.

Moreover, in the first to sixth embodiments, the reinforcement fibers 25 are bundled in parallel to each other. However, the plurality of reinforcement fibers 25 may be twisted in a spiral shape. When the reinforcement fibers 25 are twisted in the spiral shape, the length of the reinforcement fibers 25 can be set longer with respect to the length L of the rope 20 in the X-axis direction as compared to the case in which the reinforcement fibers 25 are arranged in parallel to each other. The reinforcement fiber bundles having the reinforcement fibers 25 twisted in the spiral shape may be arranged in parallel to the X-axis direction. However, when the reinforcement fiber bundles having the reinforcement fibers 25 twisted in the spiral shape are formed into the corrugated shape in the B-B section, the length of the reinforcement fibers 25 may be set larger with respect to the length L of the rope 20 in the X-axis direction, thereby being capable of further reducing the bending rigidity.

Further, in the first to sixth embodiments, the corrugated reinforcement fiber bundles 23 each have a circular sectional shape in the A-A section (for example, FIG. 3). However, the corrugated reinforcement fiber bundles 23 are not limited to have the circular sectional shape. For example, the reinforcement fibers 25 may be bundled so that the corrugated reinforcement fiber bundles 23 each have a rectangular shape in the A-A section. When the corrugated reinforcement fiber bundles 23 each have a rectangular sectional shape, the corrugated reinforcement fiber bundles 23 can be aligned without any gaps, thereby being capable of setting a content ratio of the reinforcement fibers 25 in the rope 20 to be larger than the case with the circular section. Therefore, the rope 20 having a high strength with respect to the A-A sectional area can be provided.

Further, a fiber diameter and the number of the reinforcement fibers 25 are not also particularly limited.

In the first to sixth embodiments, as the reinforcement fiber bodies, illustration is given of the corrugated reinforcement fiber bundles 23 and the parallel reinforcement fiber bundles 28, which are bundles of the reinforcement fibers 25. However, the reinforcement fiber bodies are not limited to those. For example, as the reinforcement fiber body, there may be used a corrugated sheet formed of the reinforcement fibers or a sheet laminate body in which the sheets are laminated in the Z-axis direction.

Further, the shapes of the rope and the load supporting member in section perpendicular to the longitudinal direction are not limited to the rectangular shape, and may be, for example, an elliptical shape or a circular shape.

Furthermore, in the second to sixth embodiments, the cross members 26 can be omitted.

Moreover, the configuration of the elevator to which the rope according to this invention is applied is not limited to the configuration as illustrated in FIG. 1.

Further, the rope according to this invention can be applied also to any rope other than the rope for suspending the car of the elevator. For example, the rope according to this invention can be applied to a compensation rope for an elevator or a rope to be used for a crane apparatus.

REFERENCE SIGNS LIST

3 hoisting machine, 5 drive sheave, 7 car, 20 rope, 21 load supporting member, 22 covering member, 23 corrugated reinforcement fiber bundle (reinforcement fiber body), 24 impregnation material, 25 reinforcement fiber, 26 cross member, 27 composite layer, 28 parallel reinforcement fiber bundle (reinforcement fiber body)

The invention claimed is:

1. A rope, comprising:

a load supporting member including:

an impregnation material; and reinforcement fiber bodies, which continuously extend in a longitudinal direction of the rope, are embedded in the impregnation material, and are configured to support a load acting in the longitudinal direction; and a covering member covering an outer periphery of the load supporting member, wherein the cross-sectional shape of the load supporting member is rectangular shape with a width-direction dimension larger than a thickness-direction dimension, wherein the reinforcement fiber bodies include corrugated reinforcement fiber bodies which have, at least in part, a corrugated shape in a section parallel to the longitudinal direction, wherein the corrugated reinforcement fiber bodies are curved so as to protrude alternately toward one side and another side of the load supporting member in the thickness direction, and wherein the corrugated reinforcement fiber bodies have such a length that a total length thereof given when the corrugated reinforcement fiber bodies are straightened is equal to or larger than 1.1 times a total length of the load supporting member.

2. The rope according to claim 1, wherein the corrugated reinforcement fiber bodies are divided into a plurality of groups arrayed in a width direction of the load supporting member, and wherein the corrugated reinforcement fiber bodies in the groups adjacent to each other in the width direction of the load supporting member are deviated by 180° in phase in the longitudinal direction of the load supporting member.

3. The rope according to claim 1, wherein the corrugated reinforcement fiber bodies within each group are caused to adhere to each other by the impregnation material.

4. The rope according to claim 3, wherein the plurality of groups of corrugated reinforcement fibers are caused to adhere to each other by the impregnation material.

5. A rope, comprising:

a load supporting member including:

an impregnation material; and reinforcement fiber bodies, which continuously extend in a longitudinal direction of the rope, are embedded in the impregnation material, and are configured to support a load acting in the longitudinal direction; and a covering member covering an outer periphery of the load supporting member, wherein the load supporting member further includes a plurality of cross members, which are spaced apart from each other in a longitudinal direction of the load supporting member and embedded in the impregnation material, wherein the cross members are each elongated so as to extend in a direction perpendicular to the longitudinal direction of the load supporting member, wherein the cross members have an elastic modulus larger than an elastic modulus of the impregnation material, wherein the reinforcement fiber bodies include corrugated reinforcement fiber bodies, which are, at least in part, wound around the cross members and formed into a corrugated shape, and wherein the corrugated reinforcement fiber bodies have such a length that a total length thereof given when the corrugated reinforcement fiber bodies are straightened is larger than a total length of the load supporting member.

6. The rope according to claim 5, wherein the corrugated reinforcement fiber bodies and the cross members form each of a plurality of composite layers which are arrayed in a thickness direction of the load supporting member.

7. The rope according to claim 6, wherein the reinforcement fiber bodies include parallel reinforcement fiber bodies being bundles of reinforcement fibers arranged in parallel with the longitudinal direction of the load supporting member, wherein the parallel reinforcement fiber bodies are arranged at a center of the load supporting member in the thickness direction, and wherein the composite layers are arranged on both sides of the parallel reinforcement fiber bodies in the thickness direction of the load supporting member.

8. The rope according to claim 6, wherein the corrugated reinforcement fiber bodies have a total length which is larger in the composite layer arranged closer to a surface of the load supporting member in the thickness direction.

9. The rope according to claim 5, wherein the corrugated reinforcement fiber bodies have an elastic modulus which is smaller in the composite layer arranged closer to the surface of the load supporting member in the thickness direction.

10. The rope according to claim 5, wherein the cross members have a longitudinal-direction dimension which matches with a width-direction dimension of the load supporting member.

11. The rope according to claim 5, wherein the corrugated reinforcement fiber bodies are divided into a plurality of groups arrayed in a width direction of the load supporting member, and wherein the corrugated reinforcement fiber bodies in the groups adjacent to each other in the width direction of the load supporting member are deviated by 180° in phase in the longitudinal direction of the load supporting member.

* * * * *